United States Patent [19]

Katz

[11] Patent Number: 5,009,626

[45] Date of Patent: Apr. 23, 1991

[54] HUMAN LIFELIKE DOLLS, MANNEQUINS AND HUMANOIDS AND PET ANIMAL DOLLS AND METHODS OF INDIVIDUALIZING AND PERSONALIZING SAME

[76] Inventor: Marcella M. Katz, 10573 Le Conte Ave., Los Angeles, Calif. 90024

[21] Appl. No.: 223,808

[22] Filed: Jul. 25, 1988

Related U.S. Application Data

[63] Continuation of Ser. No. 848,389, Apr. 4, 1986, abandoned.

[51] Int. Cl.[5] ..... A63H 3/36

[52] U.S. Cl. ..... 446/391; 446/372; 156/59; 156/61; 434/81

[58] Field of Search ..... 446/391, 372, 369, 268, 446/385; 156/64, 61, 59; 434/81, 82

[56] References Cited

U.S. PATENT DOCUMENTS

| | | | |
|---|---|---|---|
| 875,954 | 1/1908 | Rouech | 446/372 |
| 2,266,987 | 12/1941 | Murray | 446/369 |
| 2,309,447 | 1/1943 | Greneker | 446/391 X |
| 2,468,731 | 5/1949 | Borkland | 446/391 X |
| 3,314,329 | 4/1967 | Wolbert | 354/75 |
| 3,396,401 | 8/1968 | Nonomura | 358/296 X |
| 4,034,400 | 7/1977 | Owen et al. | 358/285 X |
| 4,159,892 | 7/1979 | Blumenaus | 101/211 X |
| 4,246,059 | 1/1981 | Hadl | 156/218 |
| 4,294,634 | 10/1981 | Mookil | 446/391 X |
| 4,423,676 | 1/1984 | Neel | 101/211 |
| 4,531,292 | 7/1985 | Pasternak | 33/32.4 X |
| 4,567,322 | 1/1986 | Tsuda | 358/304 X |
| 4,633,328 | 12/1986 | Saito et al. | 358/296 |
| 4,648,188 | 3/1987 | Blair | 446/391 X |
| 4,687,526 | 8/1987 | Wilfert | 156/64 |

FOREIGN PATENT DOCUMENTS

| | | | |
|---|---|---|---|
| 22825 | of 1908 | United Kingdom | 446/391 X |

*Primary Examiner*—Mickey Yu

*Attorney, Agent, or Firm*—Philip D. Junkins

[57] ABSTRACT

A three-dimensional lifelike representation of the head portion of a real life subject formed by applying flexible sheet fabric material bearing an imprint of the head portion of a real life subject in the form of a computer-generated printed representation of the head of the subject to a computer-selected substrate structure of configuration and size matched to the printed representation of the head of the subject. The printed representation may take the form of an azimuthal-type group of connected sector photographic projections, a warped photographic image, or a panoramic photographic image of the subjects head portion with the flexible sheet fabric material being of a type capable of conforming to the substrate structure.

5 Claims, 3 Drawing Sheets

HUMAN LIFELIKE DOLLS, MANNEQUINS AND HUMANOIDS AND PET ANIMAL DOLLS AND METHODS OF INDIVIDUALIZING AND PERSONALIZING SAME

This is a continuation of my co-pending application Ser. No. 848,389 filed Apr. 4, 1986, abandoned.

BACKGROUND OF THE INVENTION

1. Field of the Invention.

The present invention relates to dolls, mannequins and humanoids and to pet animal dolls. More particularly, the invention relates to dolls, mannequins and humanoids which have a personalized or individualized appearance, both as to facial look and expression and as to body structure, and to personalized animal dolls and toys. The present invention further relates to materials adaptable for receiving facial designs, patterns and photographic representations of real life individuals and pet animals for use in the construction of look-alike doll, mannequin and humanoid head, face and body structures and look-alike toy animals, and of methods for applying such look-alike representations thereon and shaping such materials and substratums into lifelike forms.

2. Description of the Prior Art.

In every part of the world, children play with dolls stuffed animals, puppets and other toys. Dolls of all types are collected by children and adults, and mannequins and humanoids are viewed, manipulated and utilized in a multitude of ways and settings for pleasure, recreation and business purposes. According to historians, dolls have the right to be classified as one of the first inventions of man. Anthropologists have determined that humans have been modeling their own figures for over 25,000 years. Dolls were made by the Egyptians more than three thousand years ago and doll-size figures have been found in ancient Rome and Greek tombs. Fashion dolls first appeared in France over six hundred years ago. The fashion dolls used in the royal courts of Europe to display high court dress led to the development of mannequins for the display of clothing designs for women, men and children.

Dolls have been made of a vast selection of materials from cookie dough and wood and wood pulp to fabrics and compositions of all types, including the most advanced plastics. The present invention concerns itself with both composition, cloth and plastic fabrics and cloth over plastic substrates in the manufacture of dolls. Historically, well known early cloth dolls have included the "Mothers Congress Doll" (imprinted features), "Kaptin Kiddo" (1909 comic strip doll) and "Dolly Dingle" rag and paper dolls used to promote newspapers. "Liberty Belle" with a bell dress was designed to celebrate the sesquicentennial of the United States. Liberty of London made cloth dolls of historical characters from druids to archbishops (1920). Coronation dolls of George VI and his Queen were made in 1936. Cloth "Kewpie" dolls were introduced in the 1930's (U.S. Pat. No. 1,785,800). Movie box office fame resulted in Mickey Mouse and Minnie Mouse "Character Dolls" whereas classic rag dolls were modeled after characters in child classic books, i.e. Raggedy Anne and Raggedy Andy.

The finest cloth dolls made during the period 1870–1910 came from Germany with Kathe Kruse as one of the first to make dolls that looked like real children. In 1919 Madame Lenci of Italy commissioned well-known Italian artists to create a series of doll faces. A patented process using pressed felt formed these dolls which were also dressed in elaborate coordinating felt clothes.

In 1939 a series of dolls produced by Effanbee were called "America's Children", "Look-alike" and "Portrait Dolls." Dewey Cochran developed several basic face shapes to complement these doll concepts. Three sets of 30 of these dolls were used to represent the history of America. Effanbee currently produces vinyl plastic "representative" dolls of famous personages including Winston Churchill, Teddy Roosevelt, and movie stars such as John Wayne and Clark Gable. Shirley Temple "resemblance" dolls were the most successful personality dolls of the 1930's.

American dolls have grown more and more lifelike. Dolls that cried followed the "Dy-Dee Doll" of the 1930's. The "By-Lo Baby" doll looked like a baby. Later dolls have been provided with synthetic plastic hair, washable body and head materials and a myriad of accessory items. The "Toni Doll" had washable hair made of nylon. "Toni," in her original box, came with "Toni Play Wave" hair set liquid. "Teen-age" dolls and "High Fashion" dolls, including BARBIE and KEN dolls, have been very popular over the last 25 years along with their reality oriented environmental accessories and toys. The BARBIE doll is recognized as the most successful doll ever created (nearly 100 million sold). Even a quarter century after this product's introduction, it sells at the rate of more than 6 million units per year to children and adult doll collectors. A principal example of the development of living relationships between children and dolls has been the unprecedented current success of the marketing of the CABBAGE PATCH line of dolls ("little people" soft sculpture dolls) with such dolls being adopted at the time of purchase by or for children (playing the role as parent). Lifelike dolls, mannequins and humanoids that walk and talk have become increasingly in demand and much development work has been expended to provide such items with near-human body and facial structure, surface texture and coloring.

It is an object of the present invention to provide human lifelike and look-alike dolls, mannequines and humanoids, pet animal look-alike dolls and toys and other imprinted fabric items bearing look-alike human and animal representations.

It is a further object of the invention to provide individualized and personalized look-alike dolls, mannequins and humanoids which match in appearance and body proportion a human subject.

It is a still further object of the invention to provide a doll, mannequin or humanoid that presents head and facial structure corresponding to, and bearing a printed-on photographic representation of, a real life individual.

It is another object of the invention to provide a unique method for producing individualized and personalized look-alike dolls, mannequins and humanoids, pet animal look-alike dolls and toys and other imprinted fabric items bearing look-alike humans and animal representations.

It is still another object of the invention to provide a unique method for producing a material bearing a printed-on photographic representation of a real life individual and which is conformable to a pre-form of, or adaptable to stuffing to form, a doll, mannequin or humanoid head and facial structure representation of such individual.

It is yet another object of the invention to provide a unique method for providing a material bearing a computer generated photographic representation of a real life individual in a form which is conformable to the head and facial structure representation of such individual as generated by direction of a computer.

Another object of the invention is to provide a method for producing individualized and personalized look-alike dolls, mannequins and humanoids and pet animal look-alike dolls and toys by computer reception of human or animal imagery information and computer direction of the automated manufacture of such items.

Yet another object of the invention is to provide a method for producing individualized and personalized look-alike dolls, mannequins and humanoids and pet animal look-alike dolls and toys by computer matching of human and animal imagery information with interrelated computer metric information systems to accomplish computer aided design (CAD) and computer aided manufacture (CAM) of such items and personalized look-alike printouts for home cut-and-sew kits and craft projects.

Other objects and advantages of the invention will be apparent from the following detailed description of the invention, taken with the accompaying drawings.

SUMMARY OF THE INVENTION

The present invention relates to lifelike and look-alike dolls, mannequins and humanoids, pet animal look-alike dolls and toys and other imprinted fabric items bearing look-alike human and animal representations. They are created by the computer utilization of appropriate photographs of human subjects (men, women and children and pet animals) scanned optically by an optical type detector and digitizer unit or by direct imaging of such subjects utilizing a video camera and video type digitizer. The photography or imagery performed by the system may be flat, stereoscopic, topographical or panoramic. In accordance with the methodology of the invention, the personalized photographic or visual information is converted into digital information through a digitizer by breaking down the photograph or image into an organized mesh of fine dots which each have an assigned specific numerical value representing the gray level of each dot. Where the photography or imagery is topographical (as by moire topographical photography), stereoscopic, or panoramic, the digital information represents three-dimensional photographic or imagery information.

The digitized photographic or imagery information is utilized by a computer to direct the printing out of such information by a printer fed with a flexible print-accepting material suitable for fabricating a skin-like facial surface for people dolls, mannequins and humanoids or hair-like appearance for animal dolls and toys. Such material may be carried through a computer-directed printer in accordance with methodology disclosed in my U.S. Pat. No. 4,640,529. The digitized photographic or imagery information may also be utilized by the computer to direct the selection of head and/or body substrate forms or form components, or to direct the manufacture of head and/or body substrate forms or form components and to direct the assembly of the look-alike products of the invention. The photography or imagery information, in digitized form, may be manipulated by computer software programming and by the application of retrievable data bank information relating to body and head measurements and measurement and spacial relationships. Under appropriate computer command and direction the printer prints out the photographed or imaged facial representations in:

(a) flat frontal two-dimensional photographic format and flat frontal photographic format with shading to yield three-dimensional appearance;

(b) standardized fractional pattern (azimuthal-type) units which, when cut out and assembled, form three-dimensional look-alike facial representations with profile or full silhouette parts; and (c) purposefully exagerated, extended or warped, computer-correlated (and exact measured) photogrammetric printed facial depictions or panoramic facial images which, when conformed (as by molding and stretching) to a computer selected or engendered three-dimensional facial and head substratum (craniofacial model), are normalized and naturalized to result in a look-alike head and face structure.

Flexible, print-accepting materials suitable for fabricating facial and body structures for look-alike dolls, mannequins and humanoids include woven fabrics and wool felt materials and most particularly, non-woven, spun-bonded or spunlaced synthetic fabrics, including polyester and polyester blend fabrics such as "SONTARA" brand polyester fabrics produced by E. I. DuPont de Nemours & Co. Such materials are soft, strong, conformable and light weight, impervious or apertured and, with appropriate coloring, present a skin-like appearance. Because of the conformability characteristic of some of these print-accepting materials (particularly SONTARA fabrics), i.e., ability to be stretched to conform to mold or substratum contours, they may require mounting on a stablizing type of non-woven temporary carrier material or a release paper for transport through the computer-directed printer.

The methodology of the present invention, in its production of real life images on contourable or shapable fabrics, or on non-distortable fabrics, without image distortion in its ultimate shape or contour, is applicable to the manufacture of a broad range of other personalized or individualized products, including: pet animal dolls and toys; hand and string puppets; bas relief soft sculpture, contourable image-bearing fabric products and relief forms such as pillows, soft photo album covers and purses; look-alike face masks; and innumerable fabric items which are also receptive to additional personal handcrafting (beadwork, needlework, etc.). Further, through correlating computer manipulative techniques, the face or image applied to the contourable or shapable fabric may be printed out in block pixelized grid format with the fabric constituting needlework material or printed out in pixelized format to give the appearance of needlework with optional needlework detailing. Also the face photograph or image may be, by computer direction, "posturized" or "color reversed" to form a more abstract (but personal) printed out representation of the individual or subject for which a doll or other product is to be manufactured.

PREFERRED EMBODIMENTS OF THE INVENTION

Figure 1:
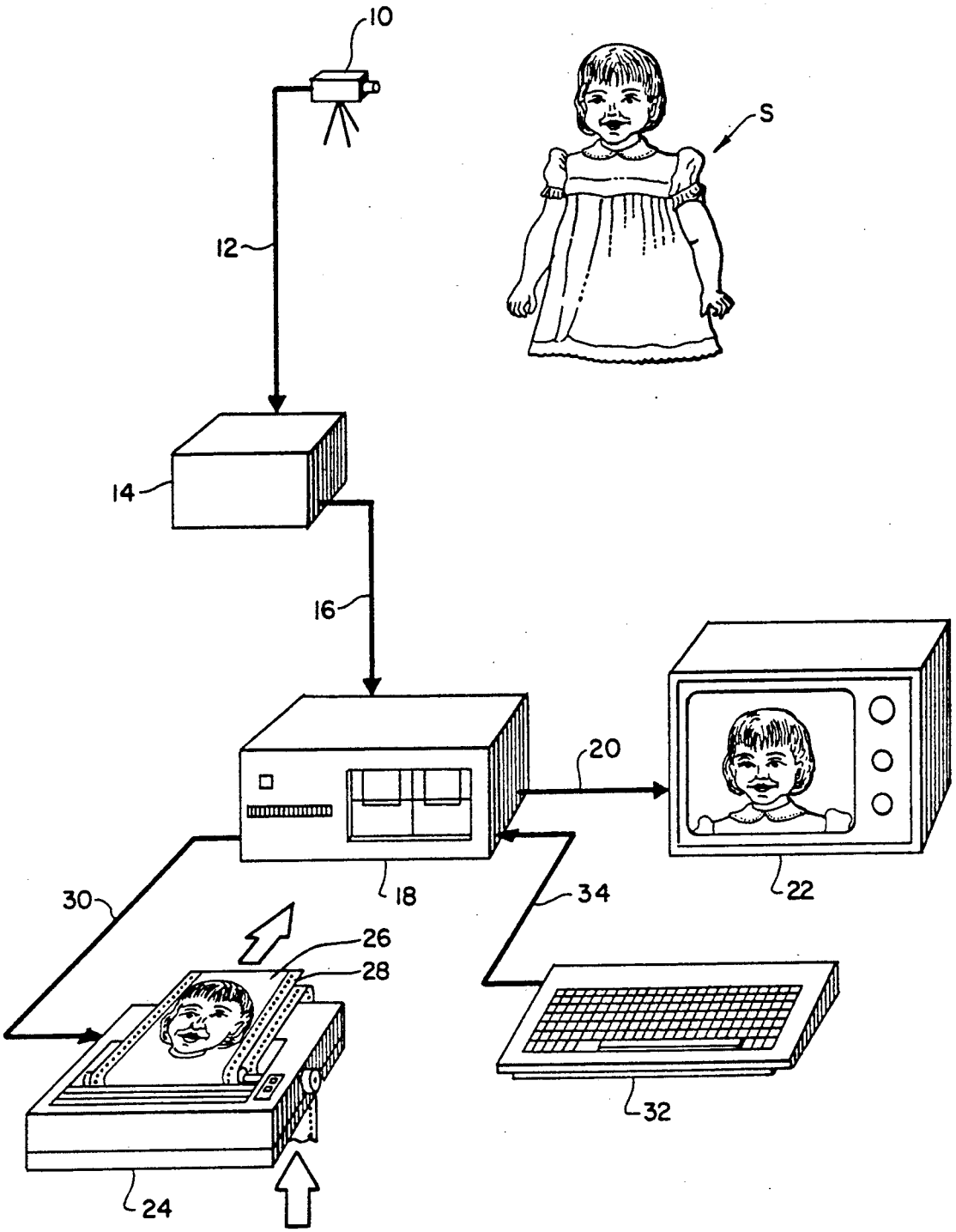
FIG. 1 is a somewhat diagramatic showing of a preferred method of applying a real life image of a human subject to a print surface of a soft, strong, and lightweight, skin-colored fabric material intended for use, in accordance with the invention, in the fabrication of lifelike dolls, mannequins and humanoids or other products to be fabricated from such material bearing the image.

Referring initially to FIG. 1 of the drawings, there is shown, in somewhat diagrammatic fashion, the methodology of applying a real life image of a human female subject in real time, in accordance with this invention, to a print surface of a soft, strong, flexible and lightweight, skin-toned or skin-colored fabric material intended for use in the fabrication of the head structure of a look-alike doll. The real life image of a subject in real time can also be supplied by video disc or tape. For the purpose of describing the methodology, the fabric material is a non-woven spunlaced polyester material which is of basic tone or skin color and which has surface characteristics completely suitable for the reception of black and white or color print. Since this polyester material is flexible and conformable it is mounted, as a primary web, on a secondary web of stabilizing non-woven temporary mount material or release paper for transport through the computer-directed printer in accordance with the disclosures of my aforementioned U.S. Pat. No. 4,640,529.

In accordance with the invention, as illustrated in FIG. 1, visual image information respecting a human child subject S, particularly the front face image information, is obtained through a video camera 10. The visual image information is transmitted through transmission cable 12 to a video signal digitizer 14. The video digitizer turns the video signals it receives into a stream of binary numbers, reducing the light intensities represented by the video signals into a high-contrast image which a computer can represent digitally. Where visual image information is obtained from a photograph of a subject, the visual information is obtained by scanning the photo through an emitter-detector system. The emitter projects a tiny beam of light onto the flat photographic image and the light sensitive detector senses the degree of lightness or darkness in each dot of the image as the beam goes over its surface. The opticaltype emitter-detector system feeds the optical signal information to an optical digitizer which develops its generated digital information on the light beam's reflection value. All digitizers convert visual information into digital information by breaking down an image into a mesh of fine dots and assigning a specific numerical value to the gray level found in each dot.

The digitized image information derived through video digitizer 14 is fed through transmission cable 16 to any one of the many available types and models of personal computers represented in FIG. 1 as micro-computer system unit 18. The micro-computer 18 converts the digital image information into visual image information and transmits same via cable 20 to a CRT display unit 22 (black and white or color picture) for viewing. The digital image information is also utilized by the micro-computer to direct a printer 24 of either the dot-matrix or laser type to print out (black and white or color) the visual image information on the primary web of printable and flexible material 26 (including spunlaced polyester fabric material) carried through printer 24 via the transport secondary web 28 of release paper. The readily available and less expensive dot-matrix printers create visual images by producing a series of dots laid out on a grid pattern. These dots are produced by one of three printing methods, i.e., impact, thermal or ink-jet. Computer direction of printer 24 is accomplished via transmission cable 30 and the computer is responsive, in its transmitting of display information to CRT display unit 22 and printout information to printer 24, to the commands generated by keyboard 32 (through cable 34) and software programs and menus and retrievable anatomical data bank information supplied to the computer relating to body and head measurements and anatomical feature relationships.

As illustrated in FIG. 1, the visual image information is printed out as a substantially flat two-dimensional look-alike representation of the subject (see FIG. 2) with the material bearing the imprinted look-alike image intended for only mild shaping on a nearly flat-faced stuffed doll. The software programs and menus and retrievable anatomical data bank information can be manipulated under keyboard direction to print out standardized fractional pattern (azimuthal-type) units (see FIG. 3) which, when cut out and assembled, form three-dimensional look-alike facial representations. Also, such programs, menus and data bank information can be manipulated to print out computer warped, polyoptic distorts of the image information (see FIG. 4) which, when conformed to a computer selected or engendered three-dimensional facial and head substratum, result in a normalized look-alike head and facial structure. Thus, through the present invention digitized image information relating to head and body images and photographs (whether flat, topographical or stereoscopic) may be computer manipulated so that such images may be displayed and printed out in: (a) flat frontal photographic format; (b) standardized azimuthal-type group of head sector photographic projections which, when cut out and assembled (seamed and stuffed), form three-dimensional look-alike head and facial reproductions; and (c) exagerated, extended, panoramic and/or distorted facial depictions or computer warped images which, when conformed (as by molding and/or stretching) to a three-dimensional artificial facial and head substratum (craniofacial model), result in a look-alike head and facial reproduction of a real life subject. Through computer engendered modularized structuring using the available stereometric information and CAD/CAM technology, look-alike head and facial reproductions may be evolved which include a substratum structure of interchangeable, numerically-determined stereotype facial parts for mount heat molding, an optional skin-layer cushioning or stuffing sub-substance and the conformable (impervious or apertured) skin-layer imprinted fabric material.

Through a data bank of statistically selected head, facial and body measurements and geometrically established body-feature and spatial relationships, a representative standard set of face and head section interlocking parts or head and body substrates may be utilized for fabricating the look-alike doll, mannequin or humanoid products of the invention. The selection of substrates or of substrate parts and their assembly can be by human hands or by robotics with such selection and assembly (in either case) being computer-directed. Thus, the micro-computer through its development of image or photographic digital information, software program direction and data bank information, can direct the appropriate look-alike printout of face, head and body imagery on appropriate flexible and conformable fabric materials and select or engender appropriate head and body substrate structures to which the printed fabric materials can be applied for fine definition, full or part molding or support to produce the look-alike end product. In alternative instances, according to the invention, the micro-computer (based upon the totality of individual body and facial imagery and/or photographic and/or photogrammetric information and available data bank information) may direct the manufacture (molding, etc.) of body and head substrates or substrate parts which match the subjects photographic or imaged body and head information and the printed fabric material bearing such information.

Figure 2:
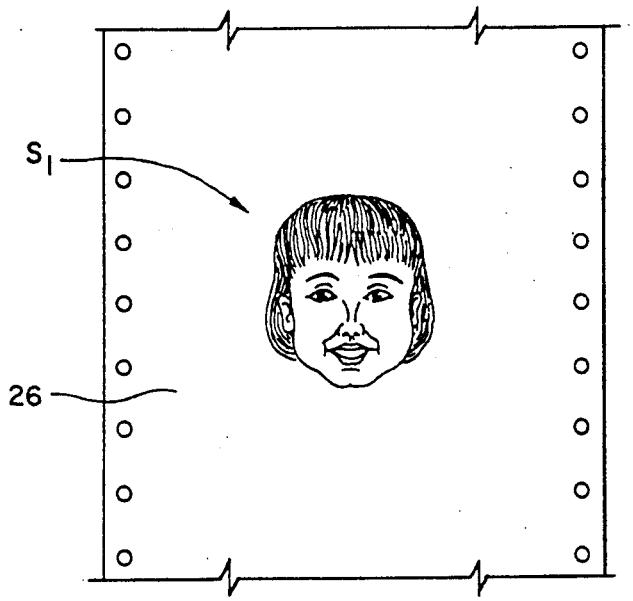
FIG. 2 is an enlarged plan view of a portion of a piece of flexible, print-accepting fabric material bearing a computer-generated flat frontal photographic real-life head image of a human subject with such fabric material provided with means for transport of the fabric through a computer-directed printer.
Figure 3:
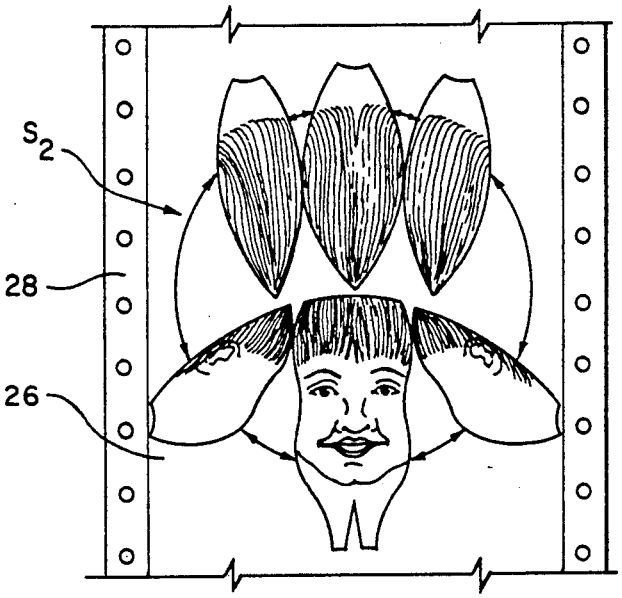
FIG. 3 is an enlarged plan view of a portion of a piece of flexible and conformable, print-accepting fabric material bearing a computer-generated, azimuthal-type group of head sector photographic projections of a human subject with such fabric material carried by a temporary pressure release material for transport of the fabric through a computer-directed printer.
Figure 4:
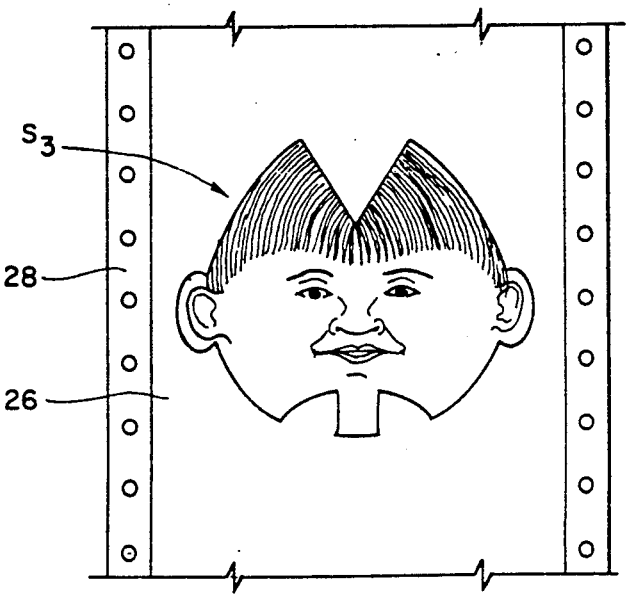
FIG. 4 is an enlarged plan view of a portion of a piece of flexible and conformable, print-accepting fabric material bearing a computer-generated, warped printout of the face of a human subject with such fabric material carried by temporary pressure release material for transport of the fabric through a computer-directed printer.

Referring now to FIGS. 2, 3 and 4, there is presented representative showings, respectively, of printouts of flat photographic imagery (FIG. 2), fractional pattern imagery or azimuthal-type sector photographic projections (FIG. 3) and conformable facial and head depictions of computer warped, panoramic images (FIG. 4) of the same subject. As illustrated, the images S1, S2 and S3 are printed out on a fabric material 26, such as a printable, flexible and non-distortable material (FIG. 2) or conformable spunlaced polyester material 26 (FIGS. 3 and 4), which is, as shown in FIGS. 3 and 4, temporarily affixed to a transport secondary web 28 for carrying the fabric material through a computer-directed printer. The printout image S1, is a two-dimensional look-alike representation of the subject S. The printout image S2 is a fractional pattern or azimuthal-type sector projection of the subject S which, when cut out, seamed (by sewing, ultrasonic welding, etc.) and stuffed and/or assembled over a three-dimensional head substratum (molded or constructed of one or more selected head parts or a total head molding), will form a 3-D look-alike doll-size representation of the subject. The printout image S3 is a distorted facial representation of the subject created by computer warping of the facial image information and is designed to result in a true facial representation of the subject when the conformable material (such as a SONTARA fabric) bearing the imprinted representation is stretched over and appropriately mounted on a computer matched (selected or manufactured) doll head substrate. If the conformable fabric material is apertured the mesh gridwork of the fabric will be made somewhat irregular in the areas where such fabric is stretched.

Figure 5:
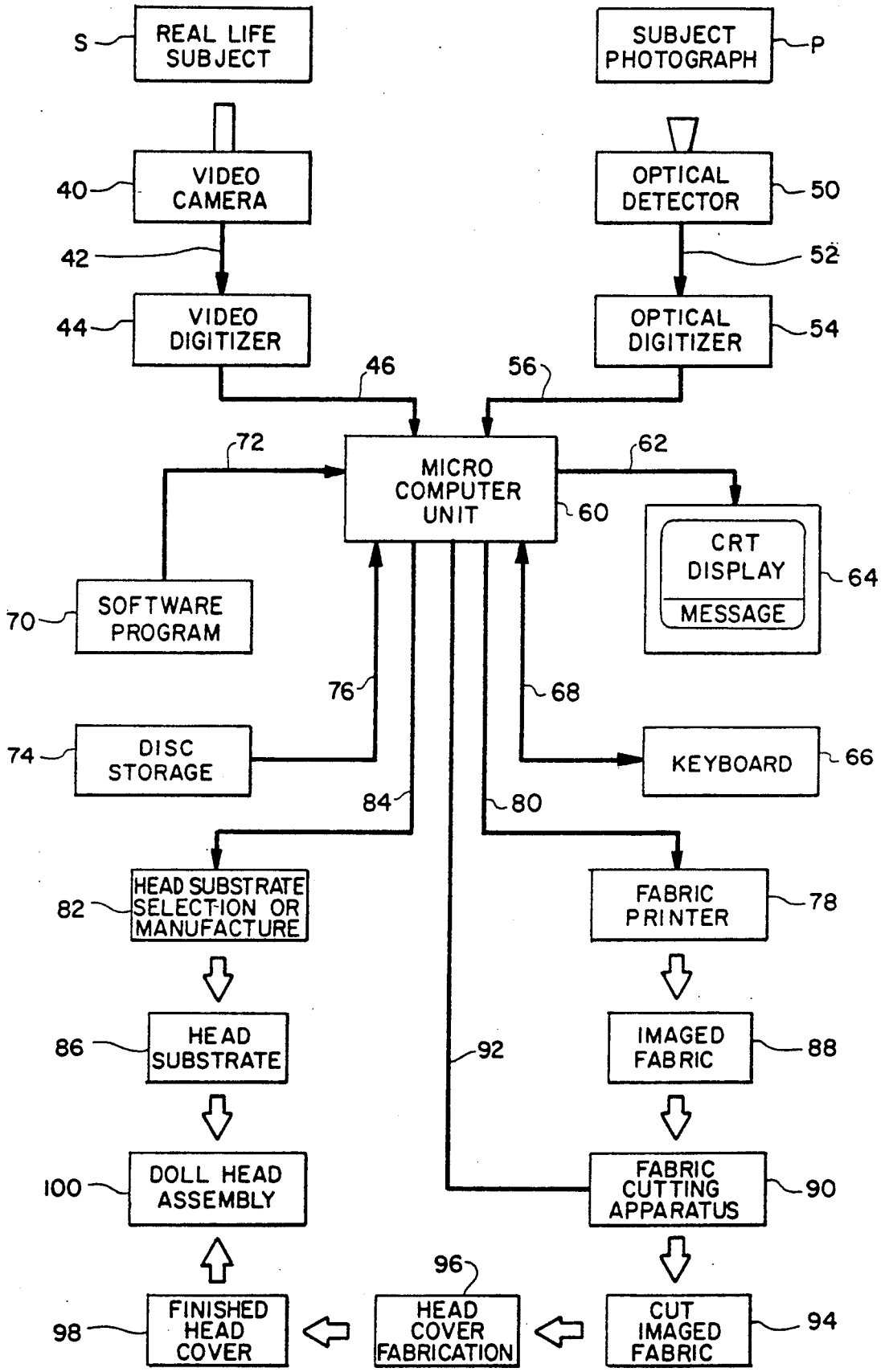
FIG. 5 is a block diagram of alternative individualized doll head fabrication methodology of the present invention.

In FIG. 5 there is presented a block diagram of alternative individualized or personalized doll head fabrication methodology in accordance with this invention. The visual information respecting a real life subject S or subject photograph P is obtained by a video camera 40 or optical detector 50, respectively. The visual image information is transmitted from the camera via transmission cable 42 to a video digitizer 44 or is transmitted from the optical detector 50 via transmission cable 52 to an optical digitizer 54. The video digitizer 44 turns the real life video signals into a stream of binary numbers as digital information and transmits such information via transmission cable 46 to a micro-computer unit 60. Alternatively, optical digitizer 54 turns the photographic visual information into digital information and transmits such information via transmission cable 56 to the micro-computer unit 60. The micro-computer 60 converts the digital information received from the video digitizer 44 or from the optical digitizer 54 into visual image information and transmits same via cable 62 to a CRT display unit 64 (black and white or color picture) for viewing the real life visual image or the photographic image. The computer 60 responds to operator commands and requests for information and direction through keyboard 66 which is interconnected to the computer by transmission cable 68. Through use of the computer, image information, software programming, data bank information and the CRT display, solid modeling of the real life subject can be accomplished.

An appropriate software program 70, with menu and message information and questions, is interconnected to the computer 60 via transmission cable 72 and retrievable data bank information (relating to body and head measurement data and anatomical feature relationships) is supplied to computer 60 from disc storage 74 via transmission cable 76. Typically, the data bank contains anatomical information concerning sixteen to twenty-two or more points of body measurement and their relation to one another and six to ten or more head measurement points and their relation to one another. Other information relating to doll anatomy, surface contouring, doll sewing and doll manufacture is also disc stored. Such information, coupled with the software instructional information and the visual information processed by the computer in response to keyboard direction, instruction and requests displayed to the operator via the message (and menu) section of the CRT display 64, results in the generation of appropriate printer instructional information and head and/or body substrate selection and/or manufacturing information. A computer-directed fabric printer 78 for producing doll head coating fabric (bearing the look-alike printout information) is supplied with printed instructional information via transmission cable 80. As previously described, the printout information may take the form of: (a) a two-dimensional photographic representation (see FIG. 2); (b) an azimuthal-type sector projection (see FIG. 3); or (c) a computer warped or panoramic representation (see FIG. 4) of a human or animal head and face. The two-dimensional photographic representation may be given a semi-three-dimensional appearance by photoshading.

The computer generated doll head or body substrate selection or manufacturing information is transmitted to the selection (or manufacturing) apparatus 82 by transmission cable 84. In its least sophicated form, the doll head manufacturing system and methodology may include the simple stuffing of a selected flat-face or semiflat-face fabric doll head substrate, of the type used in the manufacture of the well known "rag doll," to which a two-dimensional (with or without three-dimensional appearance) look-alike printout (of matched size) is applied. Azimuthal-type printouts may also be seamed into 3-D dimensions with a stuffing material used to maintain the desired doll head (3-D) shape. Alternatively, this apparatus may comprise computer-directed mechanisms (or instructions to human workers) for selecting a representative standard molded head substrate (or grouping of partial head substrates) of proper size and configuration from an inventory of such substrates. The selected single substrate (or group of partial substrates, when assembled) will have facial and head measurements and geometrically established anatomic feature relationships appropriately matched to the printout imprinted in azimuthal-type sector configuration or computer-warped or panoramic figure configuration on the doll head covering fabric. The computer selection-of-parts program may be assisted by the display of moire topographic photo overlays on the CRT unit under keyboard direction. The substrates can also be used for heat mold shaping of the imprinted head cover fabric (with heat activation of incorporated fabric stiffening agents) or shaping of the head cover fabric followed by the application of fabric stiffeners.

In more sophisticated manufacturing fashion, the apparatus 82 may comprise doll head substrate manufacturing mechanisms and robotic-type systems using CAD/CAM techniques for molding a doll head substrate or multi-part head substrate matched to the head and facial stereometrics (including mold depth measurements) and printout information by computer metrics. Such full molded head substrates and multi-part head substrates may be of solid or hollow design. As a still further alternative, the doll head substrate manufacturing system and methodology may include computer control of a multiplicity of small or micro profiling manipulators (mechanical, servo-mechanical, etc.) which create look-alike head and facial topography (in a wide range of sizes) that is matched by computer metrics and analytical photogrammetrics and/or stereometrics to the head and facial profile of a real life subject. Based upon one of the substrate selection or manufacturing alternatives, a computer-matched doll head substrate 86 is made available for final product assembly.

The imaged fabric material 88, generated by printer 78, is prepared for doll head assembly by fabric cutting apparatus 90. Such apparatus, directed by computer 60 via transmission cable 92, reads the outer boundry of the image (two-dimensional photographic reproduction or azimuthal-type sector or warped image) and directs the automated cutting of the fabric at the image perimeter. The boundry reading or scanning can be accomplished by well known lazer technology. The cut imaged fabric 94 is freed of its backing material (if such material is required for transport of the imagined fabric through the printer) and receives final doll head covering preparation and treatment via appropriate head cover finishing methodology 96. Such finishing methodology may include stitching of seams or ultrasonic welding of seams. Also, the head cover finishing or fabrication operations may include heat molding or tuck-type stitching of the image-bearing fabric material where the fabric requires stretching and distortion to produce a life-like three-dimensional substrate cover from a computer warped image. Mild tuck-type stitching may also be appropriate for the shaping of substantially flat-faced head cover fabrics and azimuthal-type head cover fabrics where the fabric is a spunlaced polyester, rayon/-polyester blend or wood pulp and polyester blended material (impervious or apertured), or other conformable synthetic material, the material itself may include a stiffening agent which is heat activated or a stiffening agent may be applied to the fabric after (or simultaneously with) its molding and distention or stretching, to maintain the three-dimensional configuration of the doll head cover. If the head cover finishing or fabrication operation involves a cut out azimuthal-type face and head sector photographic projection, the head cover requires seaming between mating sector projections to create a look-alike three-dimensional doll-head cover. Such seaming may be accomplished by a number of methods including stitching and ultrasonic seam bonding when the fabric material is comprised, at least in part, of synthetic fibers. Stiffening or semi-molding the sewn shape may result in better head shape definition. Where the cut imaged fabric 94 bears a two-dimensional photographic representation of the subject (with or without a 3-D appearance), or azimuthal-type representation, the image-bearing fabric may be used directly to form a stuffed doll head. In some instances the final operation is best accomplished by using the three-dimensional doll head substrate form as a seaming support structure. The finished head covering 98, whether flat, section seamed to a three-dimensional configuration, or heat molded to a stretched three-dimensional configuration, is joined to the appropriate head substrate 86 in a final head assembly operation 100.

It will be apparent through the foregoing descriptions of types of look-alike doll head reproductions of real life subjects in accordance with this invention and of the methodology of the invention (described for the most part in connection with the manufacture of look-alike doll heads) that a multitude of product, material and CAD/CAM method variations fall within the scope of the invention. For example, while preferred flexible and conformable polyester and polyester blend fabric materials (both impervious and apertured) have been described, other fabrics (both woven and nonwoven), plastic sheet fabrics (vinyl, etc.), spun-bonded sheet material (such as the "TYVEK" brand series of olefin fiber sheet products produced by E. I. Du Pont de Nemours & Co.) are useable in forming the inventive products and carrying out the methodology. In accordance with the type of computer-directed image printout, these latter materials may be more or less substrateconformable and/or more or less ink or dye receptive. The variety of end products within the scope of the invention is limited only by one's imaqination. The principal limitations to product type and form relate to the requirements of inclusion of a flexible or semi-flexible sheet material in the product and such material's receptiveness to some degree of imprinting through computer patternization means. The sheet material may range in surface characteristics from impervious to apertured in a regular gridwork pattern or irregular or alterable gridwork pattern. Further, the sheet material (such as non-distortable needlework canvas) may not be susceptible to molding or stretching (surface conformable). If the sheet material is conformable it may include heat activated stiffeners or be receptive to spray-on or liquid stiffeners to assure maintenance of its molded or stretched shape. Based upon computer size and shape determination of the imprinted subject matter and its printing out on sheet material, and computer matching of imprinted sheet material with the required or desired substrate structure or substance for a given product type, direction of manufacturing instructions can be given to fully automated systems and apparatus or information and instructions can be provided to human workers who make component selections and perform manufacturing procedures via such information and instructions.

The methodology of the invention contemplates full utilization by image digitization and computer manipulation of topographical information, photogrammetric measurement technology, moire topographical photography, stereometric measurement technology, stereoscopy and polyoptics, as well as azimuthal-type sector projection technology and computer warping of images. A full range of CAD/CAM techniques are involved and motion control of manipulator and robotic devices is utilized in the methodology, all as directed by computer interrelation of digitized image information. As previously indicated, real life subject imaging can be accomplished by video camera, videotape or video disc transmission. The imaging of a subject's photo can be accomplished by an optical detector. The imaging can be by sector imaging (front and profile) with the two or more sector images appropriately combined by computer matching and manipulation of the image ditigal information. Also, sweep camera and panoramic imaging techniques are available (180°–360° of sweep).

Other applications of the methodology include: biomedical 3-D modeling of body parts; head and body modeling for plastic surgery procedures; modeling of missing persons and of suspects in criminal investigations; and global and relief map making.

The methodology of the invention is not applicable solely to the doll, mannequin, humanoid and animal toy arts in its head and/or whole body look-alike reproductions. It may utilize two camera front and side (or back) simultaneous photography. It applies to other imprinted fabric items bearing look-alike human and animal representations, bas relief imagery for T-shirts and other articles of apparel, whole body fully-clothed representations and silhouette representations, posturized representations and humorous combinations of head and body art and craft forms. The computer methodology of the invention can also manipulate the realistic human image information to produce idealized, dollized and babyized representations of human subjects. The imprinted fabric items bearing look-alike human and animal representations may be supplied directly to craft artisans in kit form for hand finishing. Further, the head and body representations can be printed out as print transfers on sheet plastic materials and waxed paper materials and heat-transferred to print-accepting fabric materials covering head and body substrates. The application of needlework and other hand crafting media to imprinted flat fabric items can lend a three-dimensional shading appearance to such items and accentuate features. Azimuthal-type and computer-warped images printed out, or iron-on transfers can be utilized by individuals to create look-alike fabric masks. Shaping of the fabric can be accomplished by molding the fabric onto one's own face and thereon stiffening the fabric in its molded shape by the application of non-toxic stiffening agents to the fabric at its face interface side.

In the specification and drawing figures there has been set forth preferred embodiments of the invention and although specific terms have been employed, they are used in a generic and descriptive sense only and not for purposes of limitation, the scope of the invention being defined in the following claims.

What is claimed is:

1. A three-dimensional lifelike representation of the head portion of a real life subject comprising: flexible sheet fabric material bearing on one side thereof an imprint of the head portion of a real life subject in the form of a computer-generated printed representation of the head of said subject consisting of an azimuthal-type group of connected sector photographic projections, said sheet material being of a type capable of conforming to a substrate structure; and a computer-selected substrate structure having a three-dimensional configuration and contour of head features matched to those of said subject and of a size matched to the computer-generated printed representation of the head of said subject on said sheet material, said imprinted sheet material covering and conformed to said substrate structure and affixed thereto to form said lifelike representation of the head portion of said subject.

2. The three-dimensional lifelike representation of the head portion of a real life subject as claimed in claim 1 wherein the flexible sheet fabric material is selected from the group consisting of: non-woven synthetic fabric materials formed of spun-bonded or spunlaced fibers; woven fabric materials having a gridwork pattern with mesh apertures for receiving needlework yarn; synthetic plastic sheet material; imprintable woven fabric materials; or felted materials.

3. The three-dimensional lifelike representation of the head portion of a real life subject as claimed in claim 1 wherein the computer-generated printed representation of the head of said subject imprinted on the flexible sheet fabric material consisting of an azimuthal-type group of connected sector photographic projections of the head of said subject i seamed together at the adjacent edges of said sector projections thereby conforming said fabric material to said substrate structure to form said lifelike representation of the head portion of said subject.

4. The three-dimensional lifelike representation of the head portion of a real life subJect as claimed in claim 1 wherein the computer-selected substrate structure having a three-dimensional configuration and contour of head features matched to those of said subject and of a size matched to the computer-generated printed representation of the head of said subJect on said sheet material is selected from a set of head forms having six to ten head measurement points matched to those of the head of said subject.

5. The three-dimensional lifelike representation of the head portion of a real life subJect as claimed in claim 1 wherein the computer-selected substrate structure having a three-dimensional configuration and contour of head features matched to those of said subject and of a size matched to the computer-generated printed representation of the head of said subJect on said sheet material is selected from a set of head form interlocking parts having six to ten head measurement points when assembled matched to those of the head of said subject.

* * * * *